United States Patent [19]

Fish

[11] Patent Number: 4,921,449

[45] Date of Patent: May 1, 1990

[54] SHIELD CONNECTIONS FOR ELECTRICAL CABLE CONNECTOR

[75] Inventor: Ray F. Fish, Chatsworth, Calif.

[73] Assignee: Electro Adapter, Inc., Chatsworth, Calif.

[21] Appl. No.: 331,748

[22] Filed: Apr. 3, 1989

[51] Int. Cl.[5] ..... H01R 9/03

[52] U.S. Cl. ..... 439/610; 439/585; 439/932; 439/905

[58] Field of Search ..... 439/607, 608, 609, 610, 439/92, 98, 99, 101, 108, 578, 579, 583, 584, 585, 904, 905, 932; 174/35 C, 78, 35 R

[56] References Cited

U.S. PATENT DOCUMENTS

| | | | |
|---|---|---|---|
| 3,076,169 | 1/1963 | Blaisdell | 439/99 X |
| 4,243,290 | 1/1981 | Williams | 439/610 |
| 4,579,415 | 4/1986 | Brunt et al. | 439/608 |
| 4,615,574 | 10/1986 | Dearman | 439/607 X |

FOREIGN PATENT DOCUMENTS

| | | | |
|---|---|---|---|
| 0859613 | 1/1961 | United Kingdom | 174/35 C |

OTHER PUBLICATIONS

Shield-Kon Information, No. 5-3, 7-1965, p. 4.

*Primary Examiner*—Neil Abrams
*Assistant Examiner*—Khiem Nguyen
*Attorney, Agent, or Firm*—Harris, Kern, Wallen & Tinsley

[57] ABSTRACT

An assembnly for connecting the external electrical shield of an electrical cable to an electrical connector by means of an internal electrical shield which is electrically connected at its outer end to the connector, typically by a ferrule, a backshell and a coupling nut along with a clamp ring or band for clamping the outer end of the internal electrical shield to a sleeve of the ferrule, and electrically connecting the inner end of the internal electrical shield to the external electrical shield of the cable by another clamp which clamps the shield ends together, either directly or indirectly.

19 Claims, 3 Drawing Sheets

SHIELD CONNECTIONS FOR ELECTRICAL CABLE CONNECTOR

BACKGROUND OF THE INVENTION

This invention relates to an assembly for connecting a shielded electrical cable to a cable connector, and in particular to such an assembly for providing an electrical path between the shield of the cable and the connector.

In the conventional cable terminations, the various components which interconnect the cable and the connector are made of metal, and therefore an electrical path is readily maintained between the cable shield and the connector. However in an effort to improve resistance to corrosion and to reduce weight, many components are now being made of plastic or other non-electrical conducting materials and as a result, direct electrical paths between the cable shield and the connector are not available.

It is an object of the present invention to provide a new and improved assembly for interconnecting electrical cables and electrical connectors which will permit the use of non-electrical components while at the same time providing the desired electrical shield termination at the connector. Other objects, advantages, features and results will more fully appear in the course of the following description.

SUMMARY OF THE INVENTION

An assembly for connecting the external electrical shield of an electrical cable to an electrical connector by means of an internal electrical shield which is electrically connected at its outer end to the connector, typically by a ferrule, a backshell and a coupling nut along with a clamp ring or band for clamping the outer end of the internal electrical shield to a sleeve of the ferrule, and electrically connecting the inner end of the internal electrical shield to the external electrical shield of the cable by another clamp which clamps the shield ends together, either directly or indirectly.

DESCRIPTION OF THE PREFERRED EMBODIMENTS

Figure 1:
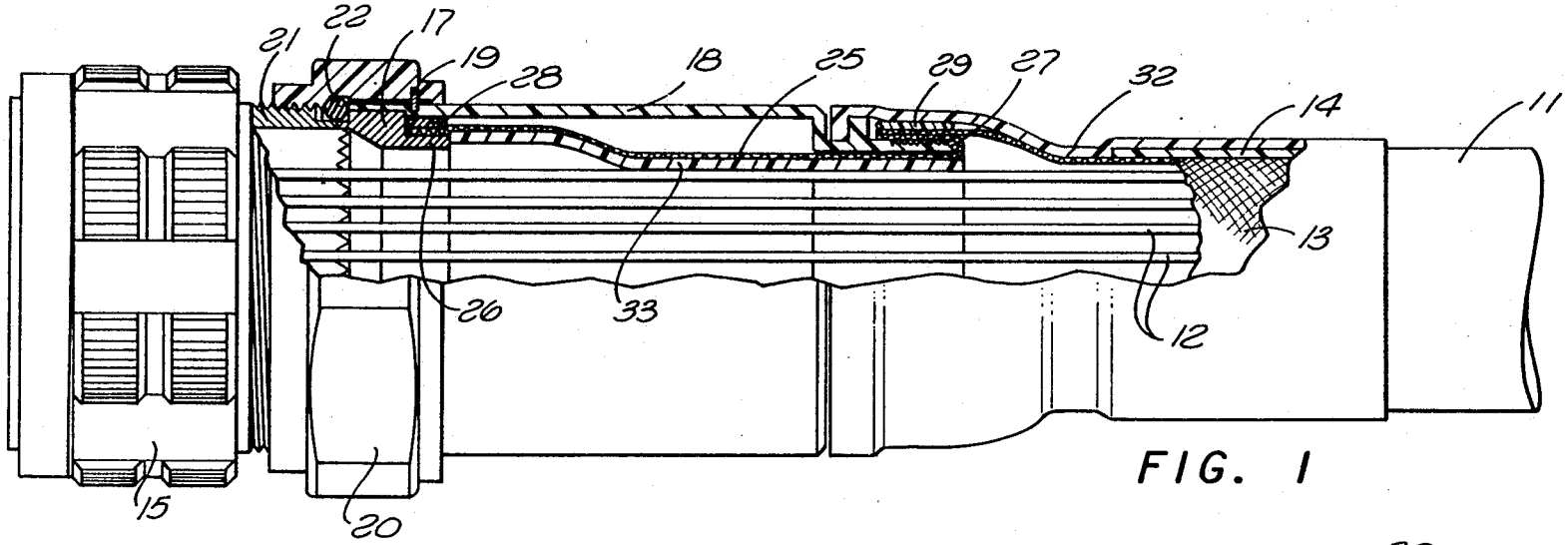
FIG. 1 is a side view, partly in section, showing an electrical cable and connector and incorporating the presently preferred embodiment of the invention.

In the embodiment of FIG. 1, an electrical cable 11 with a plurality of electrical conductors 12 enclosed by an external electrical shield 13 and an insulating layer 14 has its conductors 12 terminating at an electrical connector 15. The cable and the connector are conventional in design.

A ferrule 17 is urged into engagement with a portion 21 of the connector 15 by a backshell 18, retaining ring 19 and a coupling nut 20. An O ring 22 may be positioned between the nut 20 and the portion 21 of the connector 15 for a hermetic seal if desired.

The ferrule 17 and the connector 15 are made of an electrical conducting material, typically aluminum. The ferrule 17 and the portion 21 of the connector preferably have interengaging sawtooth edges, as illustrated in FIG. 1, for improved electrical contact between the two components.

In the embodiment illustrated, the ferrule is urged into engagement with the connector by the coupling nut 20 which is threaded onto the portion 21 of the connector, the retaining ring 19 which is positioned in grooves in the nut 20 and backshell 18, and the interengaging shoulders of the backshell and ferrule 17. Other configurations for maintaining the engagement with the connector may be utilized, and the backshell may be omitted, with the retaining ring directly engaging the ferrule.

It is desirable to provide an electrical conducting path between the external shield 13 of the cable and the connector 15 to provide electrical shielding for the conductors 12. In the conventional design this is accomplished by forming the backshell of metal, typically aluminum, and terminating the shield on the backshell. It is desirable to improve the resistance to corrosion of the cable terminations and to reduce the weight thereof. This may be accomplished by making some of the components of a lightweight plastic or other non-electrical conducting material, and in the embodiment illustrated, the coupling and the backshell are made of plastic.

An internal electrical shield 25 is incorporated in the assembly to provide the desired electrical path between the shield of the cable and the connector. An annular sleeve 26 is provided on the ferrule 17, and the outer end of the internal shield 25 is positioned over this sleeve. Another annular sleeve 27 is provided on the backshell 18 and the internal shield 25 is positioned within this sleeve with its inner end folded outward over the sleeve. The end of the external shield 13 of the cable is positioned over the inner end of the internal shield 25 on the annular sleeve 27.

The outer end of the internal shield is clamped on the sleeve 26 by a clamp 28, and the end of the external shield and the inner end of the internal shield are clamped on the annular sleeve 27 by a clamp 29. Each of these clamps may be conventional in design. The clamp may be unitary ring which is positioned over the sleeve and shrunk or compressed, as by magnaforming. In another arrangement, the clamp may be a band comprising a strip and a buckle, with the band wrapped around the shield one or more times and terminated in the buckle.

The outer surfaces of the annular sleeves may be roughened, as by knurling or by cutting or molding grooves or threads, to provide better engagement with the shields, if desired.

Figure 2:
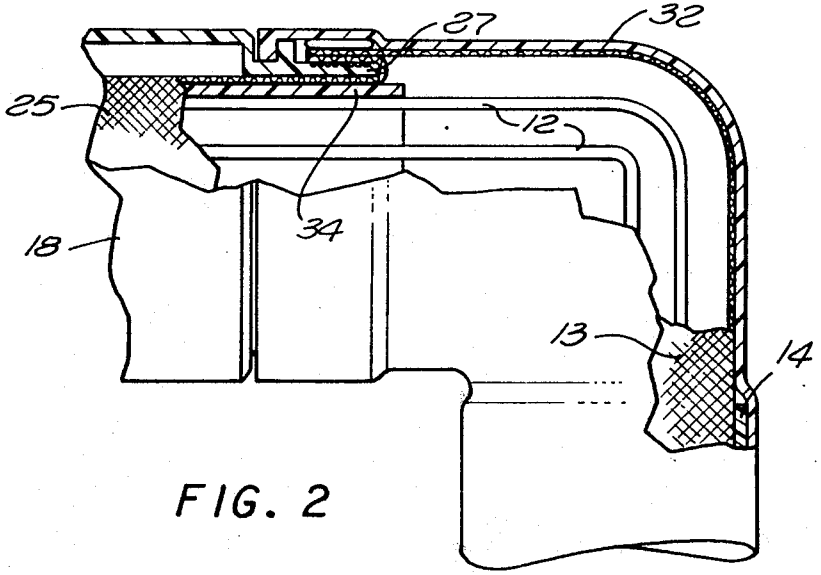
FIG. 2 is a view similar to that of FIG. 1 showing a 90 degree connection.

A boot 32 may be positioned over the exposed end of the external shield of the cable, for environmental protection if desired. Typically this boot is a sleeve of heat shrink plastic. Also if desired, an insulator boot can be positioned within the backshell. In FIG. 1, an insulator boot 33 is shown positioned inside the internal electrical shield 25. In FIG. 2, an insulator boot 34 is shown positioned inside the internal electrical shield 25.

The preferred method of assembly for the cable and connector of FIG. 1 is as follows:

1. Assemble the clamp 28 onto the internal shield 25 and the sleeve 26 of the ferrule 17, and position within the backshell 18 and coupling nut 20 to form a backshell assembly.

2. Trim the outer insulating layer or jacket 14 and the external shield 13 of the cable 11 where required to expose individual wires.

3. Place the shrink boot 32, the clamp 29, and the backshell assembly up the cable in the order used.

4. Assemble the connector contacts on the individual wires and insert into the connector 15.

5. Move the backshell assembly down the cable, screw the coupling nut 20 onto the connector 15, and torque a required.

6. Clamp the internal shield 25 onto the cable external shield 13 with the clamp 29, and, when required, onto individual wire shields 44.

7. Add adhesives, position the shrink boot 32, and shrink into position.

The connector assembly is shown in an in line configuration in FIG. 1. The assembly may also be utilized for various angles, and a 90 degree assembly is shown in FIG. 2, where components corresponding to those of FIG. 1 are identified by the same reference numerals.

Figure 3:
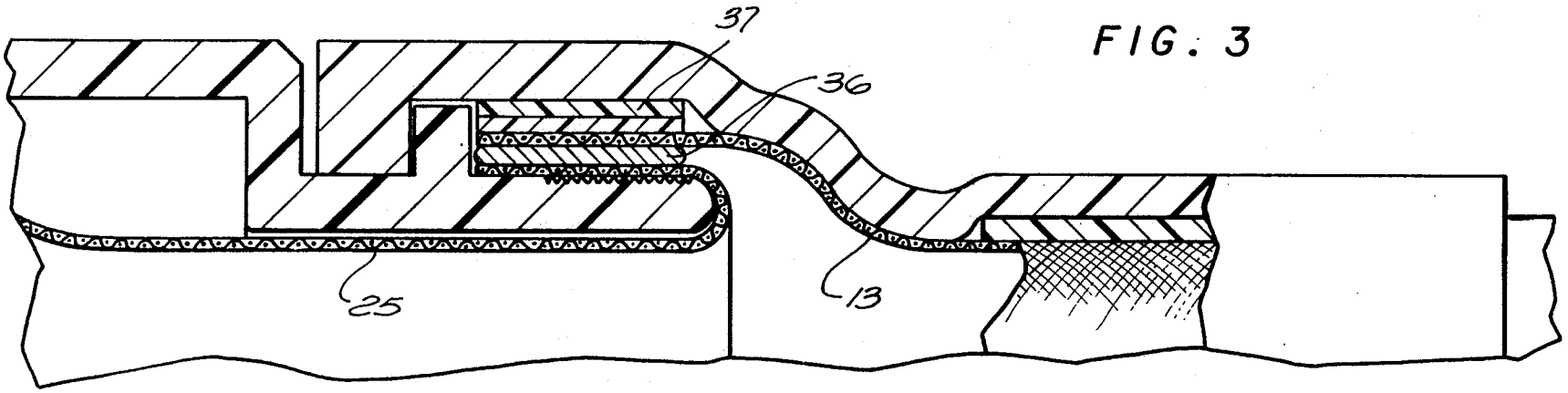
FIGS. 3, 4, 5 and 6 are enlarged partial views similar to that of FIG. 1, showing alternative embodiments of the invention.

In the embodiments of FIGS. 1 and 2, the inner end of the internal shield and the end of the outer shield are placed in direct contact with each other. In the alternative embodiment of FIG. 3, the inner end of the internal shield 25 is clamped in place by first clamp 36. The end of the external shield 13 is positioned over the clamp 36 and is held in place by a second clamp 37. In this embodiment, the first clamp 36 is shown as a single ring and the second clamp 37 is shown as a two layer strap.

Figure 4:
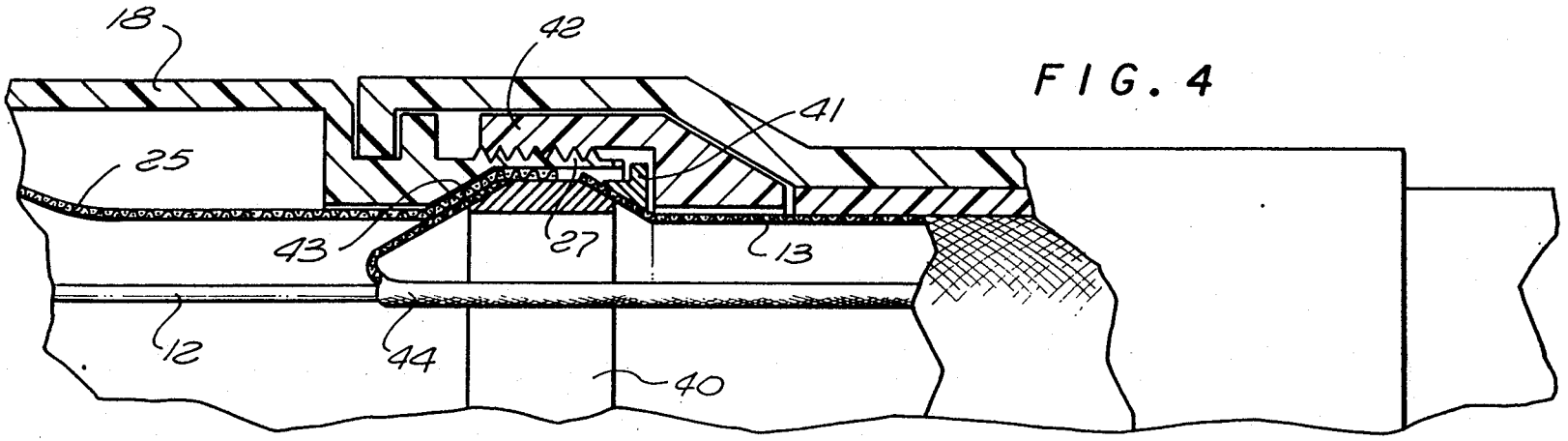

In the embodiment of FIG. 4, the means for clamping the two electrical shields together is a multicomponent assembly including a ring 40, another ring 41, and a compression nut 42. The ring 40 is made of electrical conducting material, typically a metal, and has a conical face at each side. The annular sleeve of the backshell 18 has a mating conical face 43, and the ring 41 has a mating conical face. The compression nut 42 and the annular sleeve 27 have interengaging threads.

In assembly, the inner end of the internal electrical shield 25 is positioned between the ring 40 and the backshell, the end of the external electrical shield 13 is positioned between the ring 40 and the ring 41, and the compression nut is threaded onto the backshell. This assembly clamps each of the shields to the ring 40, providing the electrical interconnection therebetween. In an alternative arrangement, the two shield ends could be positioned with one over the other and clamped at a single clamping surface.

The embodiment of FIG. 4, illustrates how one or more shields 44 on individual conductors 12 can also be clamped. The shield 44 is striped back from the conductor and the end of the shield is positioned on the ring 40 under the inner end of the internal shield 25, as shown in FIG. 4. This same arrangement can be used in any of the embodiments illustrated.

Figure 5:
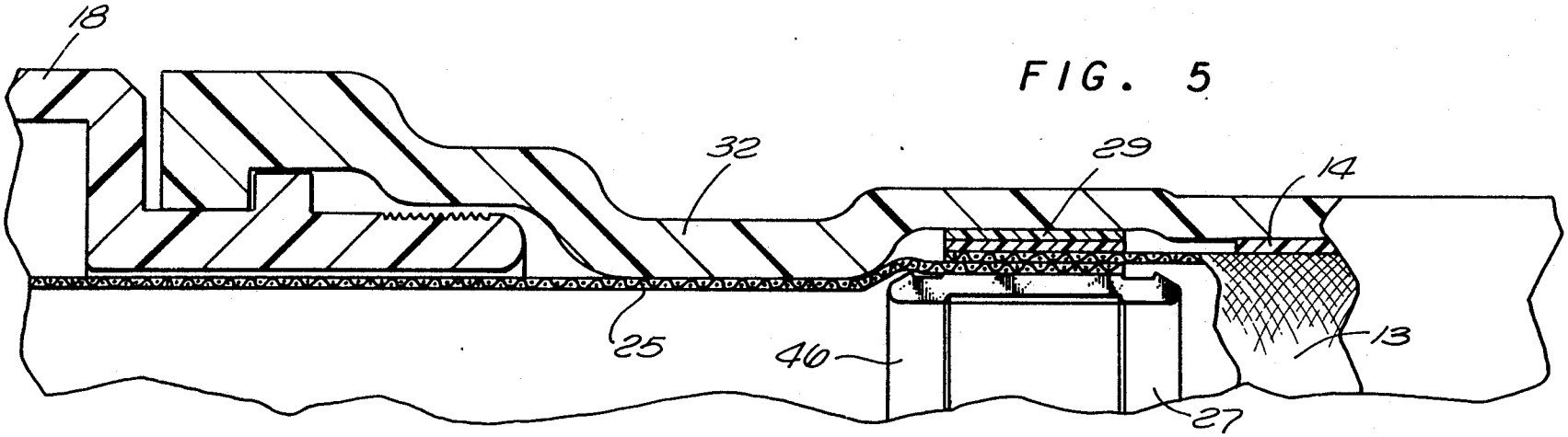

In the embodiment of FIG. 1, the annular sleeve 27 is formed as an integral part of the backshell 18. In the embodiment of FIG. 5, the annular sleeve 27 is formed separate from the backshell 18 as a split ring or split bushing, typically with two halves 46. In the embodiment illustrated, the separate annular sleeve 27 has the inner end of the internal shield 25 and the end of the external shield 13 overlaying each other and held in place by the clamp 29, shown as a double wrap band.

Some electrical cables are produced with the conductors enclosed in a helical conduit for mechanical protection, with the shield over the conduit.

Figure 6:
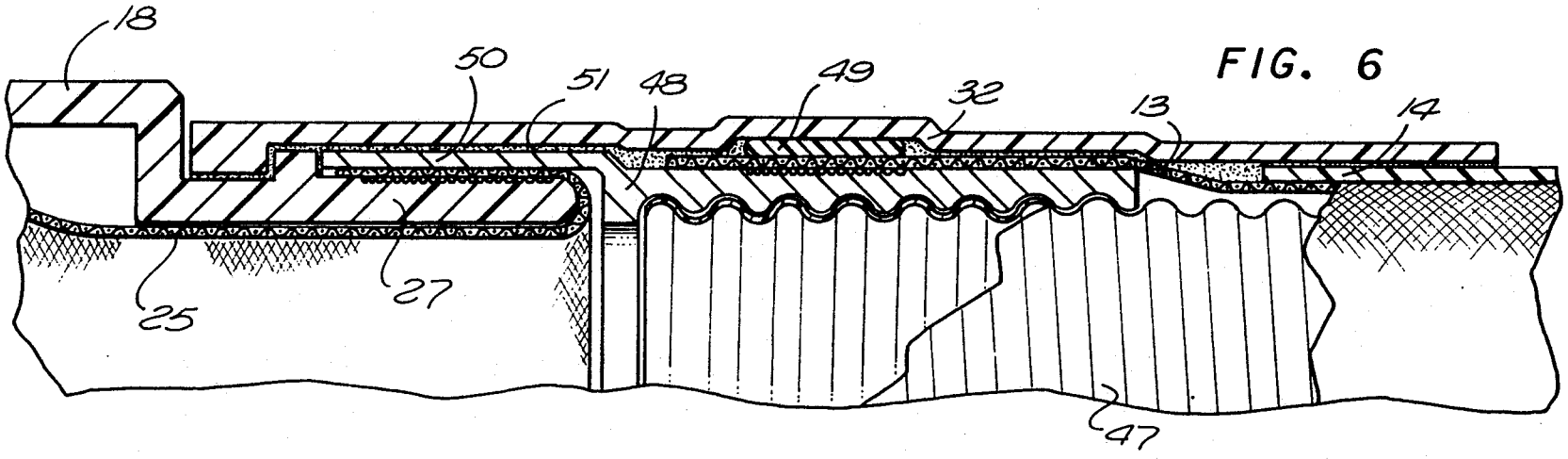

The helical conduit may be formed of plastic, and such a construction is shown in the embodiment of FIG. 6 with a helical conduit 47 and the external electrical shield 13. A conduit fitting 48 formed of an electrical conducting material, typically metal, is used as part of the clamping means. The fitting 48 has an internal helical surface for mating with the helical conduit 47, permitting the fitting to be threaded onto the conduit. The external electrical shield 13 is positioned over the fitting 48 and clamped thereto by a clamp 49 in the same manner as with the clamps 28, 29. The conduit fitting 48 includes an annular ring 50 into which the annular sleeve 27 of the backshell 18 and the inner end of the internal electrical shield 25 are positioned. The ring 50 is then compressed onto the shield and sleeve, as by magnaforming or the like. An adhesive 51 may be applied over the assembly prior to installing the boot 32, if desired. Such an adhesive may be utilized in the previously disclosed embodiments when desired.

In the assembly procedure for the embodiment of FIG. 6, the helical conduit 47 is trimmed as required, and the backshell assembly is screwed into the conduit after the shrink boot and clamp are placed up the cable. The procedure is otherwise the same as for the other embodiments.

Figure 7:
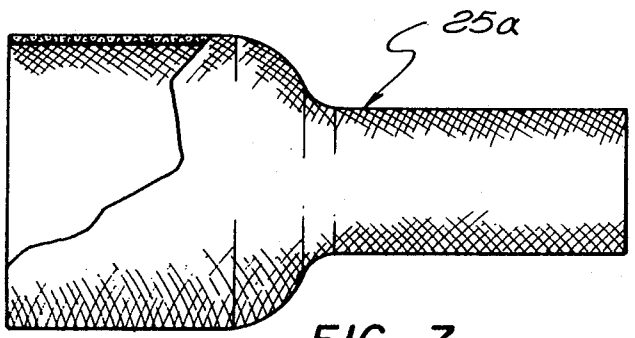
FIG. 7 is a side view, partly in section, illustrating one form for the internal shield.

The conventional shield is a woven wire mesh which is flexible. An alternative embodiment for the inner shield is shown in FIG. 7, comprising a substantially rigid structure **25*a*. The structure 25*a* may be a drawn or spun or formed metal tube, or in the preferred embodiment illustrated, may be a woven wire mesh which is plated after weaving to achieve the substantially rigid condition. Regardless of how the structure is produced, it should be sufficiently deformable at each end so that it can be installed in the manner illustrated in FIGS. 1–6**.

Thus is seen that the connecting assembly of the present invention permits the use of electrical non-conducting components while maintaining the desired electrical shielding through the entire assembly.

I claim:

1. In an assembly for connecting the external electrical shield of an electrical cable to an electrical connector, the combination of:

an electrically conducting ferrule having a first annular sleeve;

electrically non-conducting sleeve means including a rigid back shell and a second annular sleeve formed integral with said backshell;

an electrically non-conducting coupling nut for attachment to said electrical connector, with said coupling nut and ferrule having interengaging means for urging said ferrule into electrical contact with said electrical connector, and with said coupling nut and ferrule interengaging means including said backshell with said coupling nut and backshell in direct engagement over said ferrule;

an internal electrical shield having inner and outer ends;

first compressible clamp means for clamping said internal electrical shield outer end to said first annular sleeve; and second compressible clamp means for clamping said internal electrical shield inner end to said second annular sleeve and to said electrical cable external electrical shield, providing an enclosed electrical conducting path from said electrical cable external electrical shield through said internal electrical shield to said ferrule.

2. An assembly as defined in claim 1 wherein said backshell and ferrule have interengaging shoulder means; and including a retaining ring engaging said coupling nut and backshell, whereby an axial force produced by movement of said coupling nut toward said connector urges said coupling nut against said retaining ring against said backshell against said ferrule against said electrical connector.

3. An assembly as defined in claim 1 wherein said internal electrical shield is disposed inside said second annular sleeve with said inner end of said internal electrical shield folded outward over said second annular sleeve.

4. An assembly as defined in claim 1 wherein said first clamp means includes a closed ring.

5. An assembly as defined in claim 1 wherein said first clamp means includes a strap with buckle.

6. An assembly as defined in claim 1 wherein said second clamp means includes a closed ring.

7. An assembly as defined in claim 1 wherein said second clamp means includes a strap with buckle.

8. An assembly as defined in claim 1 wherein said internal electrical shield is a substantially flexible woven structure.

9. An assembly as defined in claim 1 wherein said internal electrical shield is a substantially rigid structure.

10. An assembly as defined in claim 1 including an electrically insulating sleeve positioned between said first and second annular sleeves and inside said internal electrical shield.

11. An assembly as defined in claim 1 wherein said second clamp means includes a first clamp member over said inner end of said internal electrical shield, with said external electrical shield over said first clamp member, and a second clamp member over said external electrical shield.

12. In an assembly for connecting the external electrical shield of an electrical cable to an electrical connector, the combination of:

an ferrule having a first annular sleeve;

sleeve means defining a second annular sleeve;

a coupling nut for attachment to said electrical connector, with said coupling nut and ferrule having interengaging means for urging said ferrule into electrical contact with said electrical connector;

an internal electrical shield having inner and outer ends;

first clamp means for clamping said internal electrical shield outer end to said first annular sleeve; and second clamp means for clamping said internal electrical shield inner end to said second annular sleeve and to said electrical cable external electrical shield;

with said second clamp means including a first ring, a second ring and a compression nut, with said inner end of said internal electrical shield positioned between said first ring and said second annular sleeve and with said external electrical shield positioned between said first and second rings, and with said second annular sleeve and compression nut having interengaging means for advancing said nut along said second annular sleeve and clamping said external and internal shields against said first ring.

13. In an assembly for connecting the external electrical shield of an electrical cable to an electrical connector, the combination of:

an ferrule having a first annular sleeve;

sleeve means defining a second annular sleeve;

a coupling nut for attachment to said electrical connector, with said coupling nut and ferrule having interengaging means for urging said ferrule into electrical contact with said electrical connector;

an internal electrical shield having inner and outer ends;

first clamp means for clamping said internal electrical shield outer end to said first annular sleeve; and second clamp means for clamping said internal electrical shield inner end to said second annular sleeve and to said electrical cable external electrical shield;

with said electrical cable having its conductors enclosed in a helical conduit with the external electrical shield over the conduit, and with said second clamp means including an electrical conducting conduit fitting having an internal opening mating with said helical conduit for receiving said helical conduit and a third annular sleeve overlaying said second annular sleeve, with said internal shield inner end positioned between said second and third annular sleeves, and with said external electrical shield overlaying said conduit fitting and clamped thereto.

14. In an assembly for connecting the external electrical shield of an electrical cable to an electrical connector, the combination of:

an electrically conducting ferrule having a first annular sleeve;

an electrically non-conducting backshell having a second annular sleeve;

a coupling nut for attachment to said electrical connector with said coupling nut, backshell and ferrule having interengaging means for urging said ferrule into electrical contact with said connector, and with said coupling nut and backshell in direct engagement over said ferrule;

an internal electrical shield having inner and outer ends;

first clamp means for clamping said internal electrical shield outer end to said first annular sleeve; and second clamp means for clamping said internal electrical shield inner end to said second annular sleeve and to said electrical cable external electrical shield, providing an enclosed electrical conducting path from said electrical cable external electrical shield through said internal electrical shield to said ferrule.

15. In an assembly for connecting the external electrical shield of an electrical cable to an electrical connector, the combination of:

an electrically conducting ferrule having a first annular sleeve;

sleeve means defining a backshell and a second annular sleeve, with at least said backshell being electrically non-conducting;

a coupling nut for attachment to said electrical connector, with said coupling nut and ferrule having interengaging means for urging said ferrule into electrical contact with said electrical connector, and with said coupling nut and ferrule interengaging means including said backshell with said coupling nut and backshell in direct engagement over said ferrule;

an internal electrical shield having inner and outer ends;

first clamp means for clamping said internal electrical shield outer end to said first annular sleeve; and second clamp means for clamping said internal electrical shield inner end to said second annular sleeve and to said electrical cable external electrical shield, providing an enclosed electrical conducting path from said electrical cable external electrical shield through said internal electrical shield to said ferrule, said second clamp means including a first ring, a second ring and a compression nut, with said inner end of said internal electrical shield positioning between said first ring and said second annular sleeve and with said external electrical shield positioned between said first and second rings, and with said second annular sleeve and compression nut having interengaging means for advancing said nut along said second annular sleeve and clamping said external and internal shields against said first ring.

16. In an assembly for connecting the external electrical shield of an electrical cable to an electrical connector, the combination of:

an electrical conducting ferrule having a first annular sleeve;

an electrically non-conducting backshell;

a second annular sleeve separate from said backshell;

a coupling nut for attachment to said electrical connector, with said coupling nut, backshell and ferrule having interengaging means for urging said ferrule into electrical contact with said electrical connector, and with said coupling nut and backshell in direct engagement over said ferrule;

an internal electrical shield having inner and outer ends;

first clamp means for clamping said internal electrical shield outer end to said first annular sleeve; and second clamp means for clamping said internal electrical shield inner end to said second annular sleeve and to said electrical cable external electrical shield, providing an enclosed electrical conducting path from said electrical cable external electrical shield through said internal electrical shield to said ferrule.

17. In an assembly for connecting the external electrical shield of an electrical cable to an electrical connector, the electrical cable having its conductors enclosed in a helical conduit with the external electrical shield over the conduit, the combination of:

an electrical conducting ferrule having a first annular sleeve;

an electrically non-conducting backshell having a second annular sleeve;

a coupling nut for attachment to said electrical connector with said coupling nut, backshell and ferrule having interengaging means for urging said ferrule into electrical contact with said connector, and with said coupling nut and ferrule interengaging means including said backshell with said coupling nut and backshell in direct engagement over said ferrule;

an internal electrical shield having inner and outer ends;

first clamp means for clamping said internal electrical shield outer end to said first annular sleeve; and second clamp means for clamping said internal electrical shield inner end to said second annular sleeve and to said electrical cable external electrical shield, said second clamp means including an electrical conducting conduit fitting having an internal opening mating with said helical conduit for receiving said helical conduit and a third annular sleeve overlaying said second annular sleeve, with said internal shield inner end positioned between said second and third annular sleeves, and with said external electrical shield overlaying said conduit fitting and clamped thereto, providing an enclosed electrical conducting path from said electrical cable external electrical shield through said internal electrical shield to said ferrule.

18. In an assembly for connecting the external electrical shield of an electrical cable to an electrical connector, the combination of:

an electrically conducting ferrule having a first annular sleeve;

an electrically non-conducting rigid backshell;

a second electrically conducting annular sleeve;

an electrically non-conducting coupling nut for attachment to said electrical connector, with said coupling nut and ferrule having interengaging means for urging said ferrule into electrical contact with said electrical connector, and with said coupling nut and ferrule interengaging means including said backshell with said coupling nut and backshell in direct engagement over said ferrule;

an internal electrical shield having inner and outer ends;

first compressible clamp means for clamping said internal electrical shield outer end to said first annular sleeve; and second compressible clamp means for clamping said internal electrical shield inner end to said second annular sleeve and to said electrical cable external electrical shield, providing an enclosed electrical conducting path from said electrical cable external electrical shield through said internal electrical shield to said ferrule.

19. In an assembly for connecting the external electrical shield of an electrical cable to an electrical connector, the combination of:

an electrically conducting ferrule having a first annular sleeve;

sleeve means defining a backshell and a second annular sleeve, with at least said backshell being electrically non-conducting;

a coupling nut for attachment to said electrical connector, with said coupling nut and ferrule having interengaging means for urging said ferrule into electrical contact with said electrical connector, and with said coupling nut and ferrule interengaging means including said backshell with said coupling nut and backshell in direct engagement over said ferrule;

an internal electrical shield having inner and outer ends;

first clamp means for clamping said internal electrical shield outer end to said first annular sleeve; and second clamp means for clamping said internal electrical shield inner end to said second annular sleeve and to said electrical cable external electrical shield, providing an enclosed electrical conducting path from said electrical cable external electrical shield through said internal electrical shield to said ferrule.

* * * * *